United States Patent [19]

Payne, Jr.

[11] Patent Number: 4,515,328

[45] Date of Patent: May 7, 1985

[54] INCREMENTAL MODULAR CREEL SYSTEM

[75] Inventor: William M. Payne, Jr., Greensboro, N.C.

[73] Assignee: Burlington Industries, Inc., Greensboro, N.C.

[21] Appl. No.: 552,799

[22] Filed: Nov. 17, 1983

[51] Int. Cl.[3] ..... B65G 7/00; B65H 49/14; B65H 67/02; D01H 9/00

[52] U.S. Cl. ..... 242/131; 28/193; 57/276; 57/281; 198/477; 242/35.5 A; 414/331

[58] Field of Search ..... 242/131, 131.1, 35.5 A; 28/193; 57/90, 281, 276; 414/331; 198/477, 680

[56] References Cited

U.S. PATENT DOCUMENTS

| | | | |
|---|---|---|---|
| 2,588,053 | 3/1952 | Smith et al. | 242/131 |
| 3,015,147 | 1/1962 | Croxton et al. . | |
| 3,452,947 | 7/1969 | Thurman | 242/131 |
| 3,586,178 | 6/1971 | Zurheide et al. | 242/131.1 |
| 3,753,274 | 8/1973 | Koslowski | 242/131.1 |
| 3,977,542 | 8/1976 | Stolzer | 414/331 |
| 4,019,700 | 4/1977 | King | 242/131.1 |
| 4,041,686 | 8/1977 | Inaba et al. | 57/281 |
| 4,269,368 | 5/1981 | Rapp et al. | 242/42 |
| 4,344,582 | 8/1982 | Rapp et al. | 242/45 |

*Primary Examiner*—Stuart S. Levy
*Assistant Examiner*—Stuart J. Maltzman
*Attorney, Agent, or Firm*—Cushman, Darby & Cushman

[57] ABSTRACT

A method and system for facilitating a continuous and automated taking-off of yarn from yarn packages. A creel module having one or a plurality of yarn package receiving creel pins disposed in one or more rows is automatically loaded with yarn packages at a loading position. The loaded module is conveyed, optionally through a buffer storage system, to operative association with a stationary creel frame. The module is transferred from the conveying mechanism to the creel frame, and is mounted with respect to the creel frame so that the yarn may be taken off the packages thereof. After the yarn from the module packages has been exhausted, the module is removed from the creel frame and conveyed back to the loading position, while it is replaced with another, loaded, module. Two modules, each with two rows of yarn packages, may be provided at each creeling position on the creel frame, the yarn being taken off each of the packages of each row of each module at the creeling position in succession, and each module when exhausted being replaced by a loaded module.

21 Claims, 14 Drawing Figures

TEXTURING MACHINE CREEL
CARRIER
ROBOT
VENDOR CARTON
15
15
15
17
17
33
55
10
10
12
13
51
52

92
92
97
97
95
96
352
357
351
94
93
93
315
310
310
317
333

INCREMENTAL MODULAR CREEL SYSTEM

BACKGROUND AND SUMMARY OF THE INVENTION

There are many procedures in industry wherein it is necessary to properly support a yarn package so that the yarn may be readily taken off the package, and the yarn package may be replaced when exhausted. In the textile industry in particular there are numerous textile processes requiring proper positioning of yarn packages for continuous yarn takeoff, such as texturing, warping, twisting, cone winding, drawing, tufting, and ring spinning operations.

In a typical conventional textile process, each machine transforms multiple packages of yarn—after treatment (e.g. texturing)—to multiple treated yarn packages. Typically, packages of the treated yarn (e.g. textured yarn) are moved in groups in some type of container to temporary storage. Subsequently the containers of packages are moved to the next process, where the individual packages are manually transferred to a machine creel, for use in the process (e.g. spinning). The doffing of multiple yarn packages, their subsequent storage movement, and creeling of multiple yarn packages require substantial labor. Also such processes can have a fair amount of waste associated therewith, and machine efficiency is less than desirable.

According to the present invention, a method and system are provided for creeling and doffing of multiple yarn packages, particularly for textile processes, which avoid many of the drawbacks associated with conventional doffing and creeling methods and systems. According to the method and system of the present invention, there is a substantial reduction in labor requirements, reduced waste, and improved machine efficiency.

A basic element utilizable in the practice of the method of the present invention, and as part of the system of the present invention, is a creel module. The module has one or a plurality of yarn package-receiving creel pins associated therewith. Preferably the creel pins are positioned so as to define a plurality of rows; for instance two rows of creel pins are provided with a plurality of yarn packages mounted in each row.

The empty modules are brought from a queue, loaded with yarn packages, as with automatic loading equipment, at a loading position. The loaded creels are passed to a buffer position, and ultimately conveyed, as with an overhead conveyor, to positions adjacent a creel frame. When adjacent the creel frame, the loaded modules are transported from the conveyor into operative association with the creel frame, and are positioned so that the running ends of the yarn packages may be readily acted upon by a consuming machine, so that the yarn is taken off the yarn packages.

After exhausting all of the yarn packages of each module, the module is removed from the creel frame and is replaced with another, loaded, module. The exhausted module is transported by the conveying means in a closed loop back to a buffer zone and subsequently brought to the loading position, wherein it is again loaded with yarn packages.

Where each module includes first and second rows of yarn packages, preferably first and second modules are associated with each creeling position on the creel frame. The yarn packages of the first and second modules at each creel position are operatively connected so that they are exhausted in the following order: first module, first row; second module, first row; first module, second row; and second module, second row. The modules are rotated 180° about a vertical axis after the exhausting of each row of yarn packages thereof, so that the next row of yarn packages is in operative position to be readily taken off by the consuming machine. When a module is exhausted, it is replaced with another, loaded, module. In this way, there may be continuous yarn take-off from each creeling position, with the only labor input necessary being the connecting of the tail of each running yarn package to the running end of the next yarn package to be utilized.

The invention is utilizable in numerous segments of the textile industry. Whether the invention is utilized in high style segments of the industry—where there are small batches or production runs—or staple segments where textiles are produced in large volumes, in long runs, which may occupy single or multiple machines for long periods of times—the invention is advantageous.

Where volumes are extremely low, it is desirable to have premetered packages and to employ block creel processes such that exact quantities needed in each manufacturing cycle are produced. In this type environment, product accumulates between processes and is consumed in "slugs" or quantities sufficient to creel one machine at a time. For example, in warping of industrial products, 1200 packages may be creeled of a product in one slug, warped, and then changed to a new product type.

Where block creeling is employed, the creel module according to the invention substantially reduces the machine changeover time at lot changes. Whereas currently, the creel is unloaded and reloaded package by package for each new product on a manual basis, according to the invention, mechanical loading and unloading of modules, each containing multiple packages, will be practiced. Thus it can be seen that machine downtime will be reduced and labor requirements reduced. Assuming mechanical loading/unloading of modules, labor will be reduced to tieing of ends between the old and new product, and a pullover (to get the new product threaded through the tensioning guides) and then starting the machine cycle. Because of the nature of the product manufactured, labor requirements unavoidably arise at the end of batches. Typically, these type operations must overstaff with additional employees to achieve reasonable levels of machine productivity.

Conversely, large manufacturing runs involve days, weeks, and months of the same product on the same machine. Here—by practicing the invention—the opportunity exists to regulate the arrival of work in such a way that overall manning requirements are reduced to compare with those for small lot manufacturing requirements. This is accomplished by initially "seeding" the creel with modules, each having packages of the same length, and with the length of packages varying between modules. After the initial row of packages, all subsequent rows have yarn packages of the same length. Once "seeded" the order and arrival rate are established for the future. The transfer of the thread lines from one module to another provides a continuous supply of yarn to the process.

It should be understood that the modular creel concept according to the invention can be adapted to meet the needs of any manufacturing batch size. Not only does it provide creeling of multiple packages in one module, a savings over individual package handling, but it may be operated in either a random or block creeling mode to meet the specific production requirements of manufacturing. This characteristic flexibility of the invention is a major advantage thereof.

It should also be understood that the creel module provides a method for reducing handling costs. Once packages are doffed and positioned on the modules in a first process, a second process may be creeled by positioning the module containing multipe packages in a creel of a second process. Handling of individual packages at the second process is eliminated.

Other aspects of the invention will become clear from an inspection of the detailed description of the invention, and from the appended claims.

Figure 1:
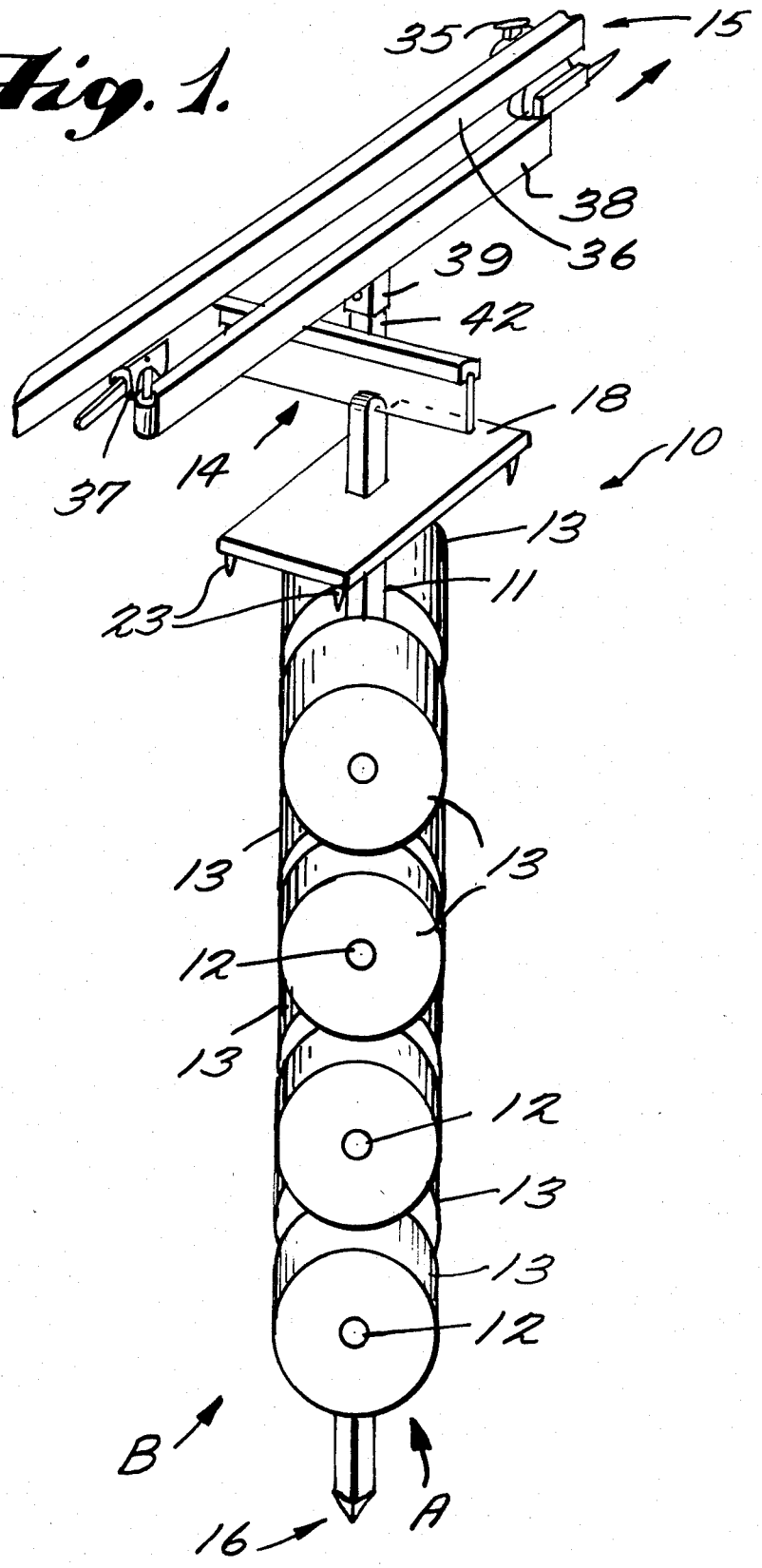
FIG. 1 is a perspective schematic view of an exemplary creel module according to the present invention, shown in operative association with an overhead conveyor.
Figure 6:
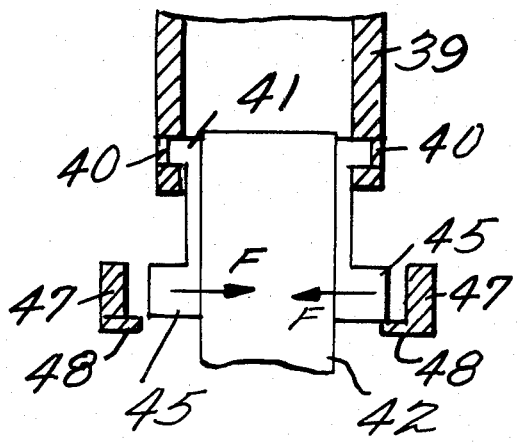
Figure 3B:
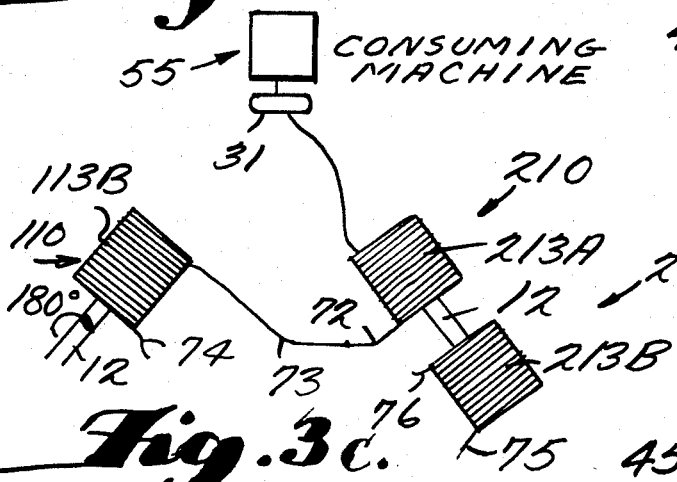
Figure 7:
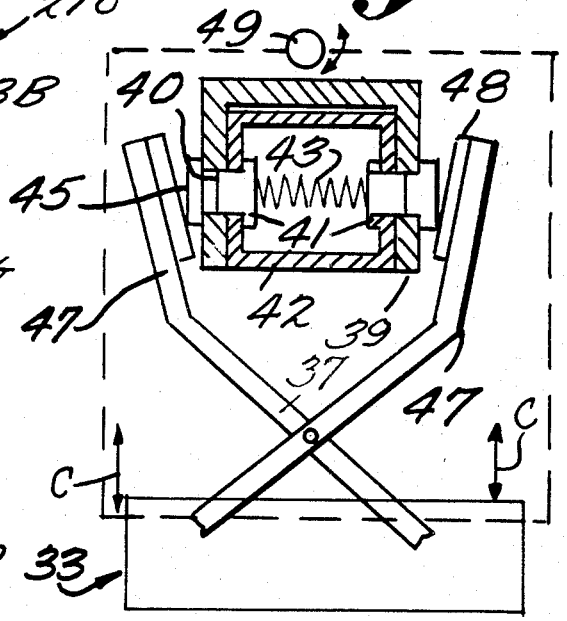
Figure 4:
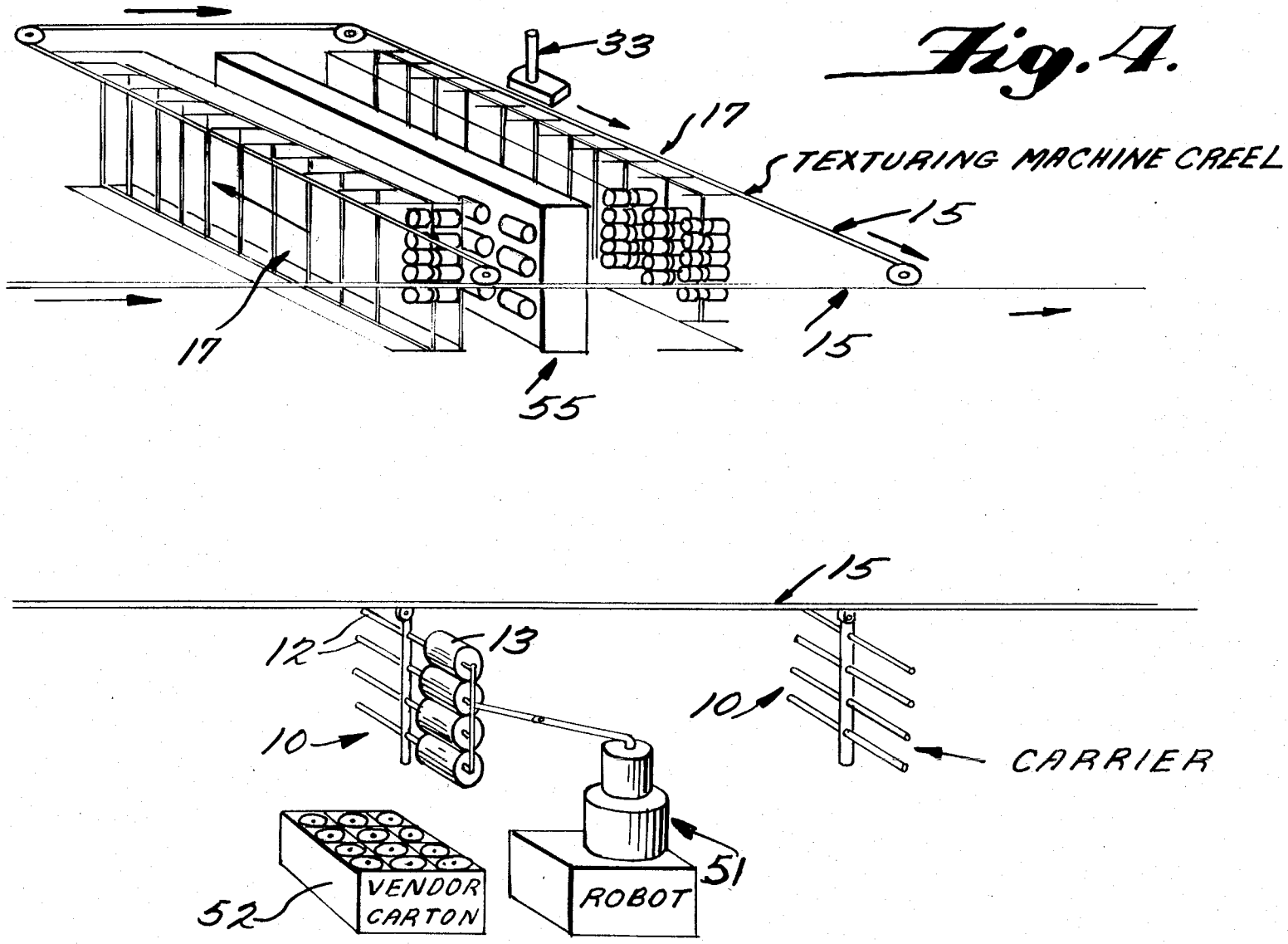
Figure 5:
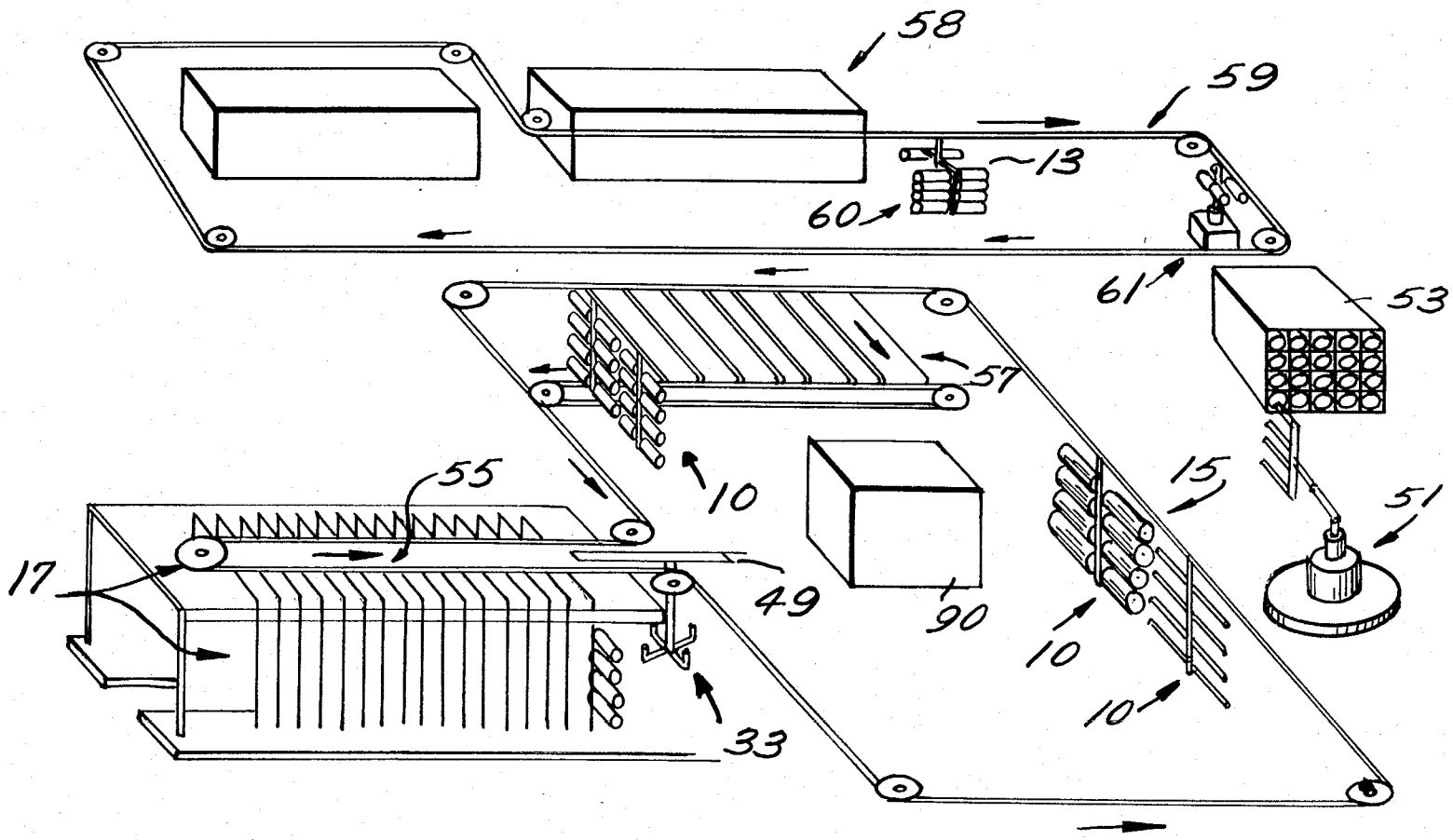
Figure 8:
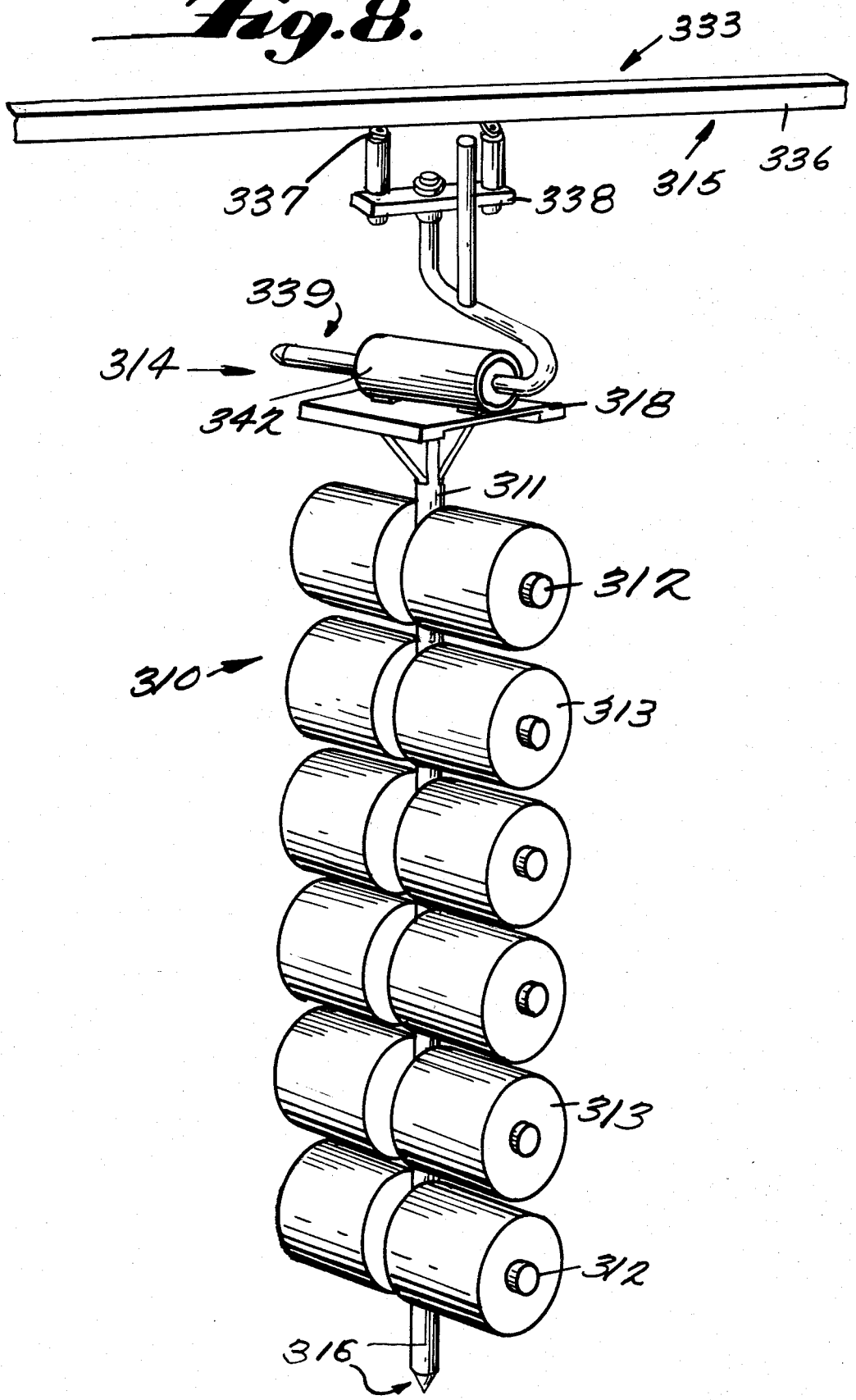
Figure 9:
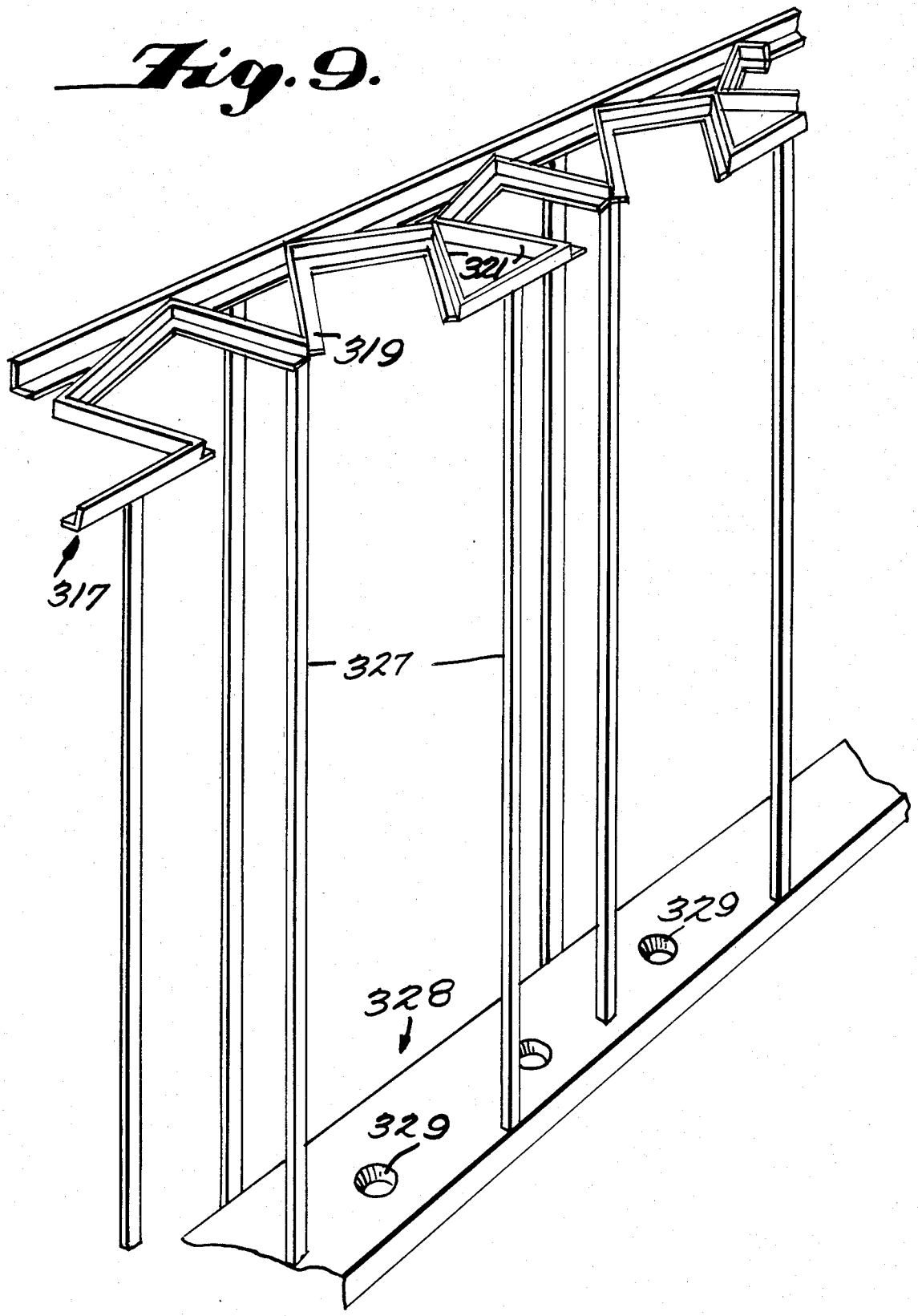
Figure 10:
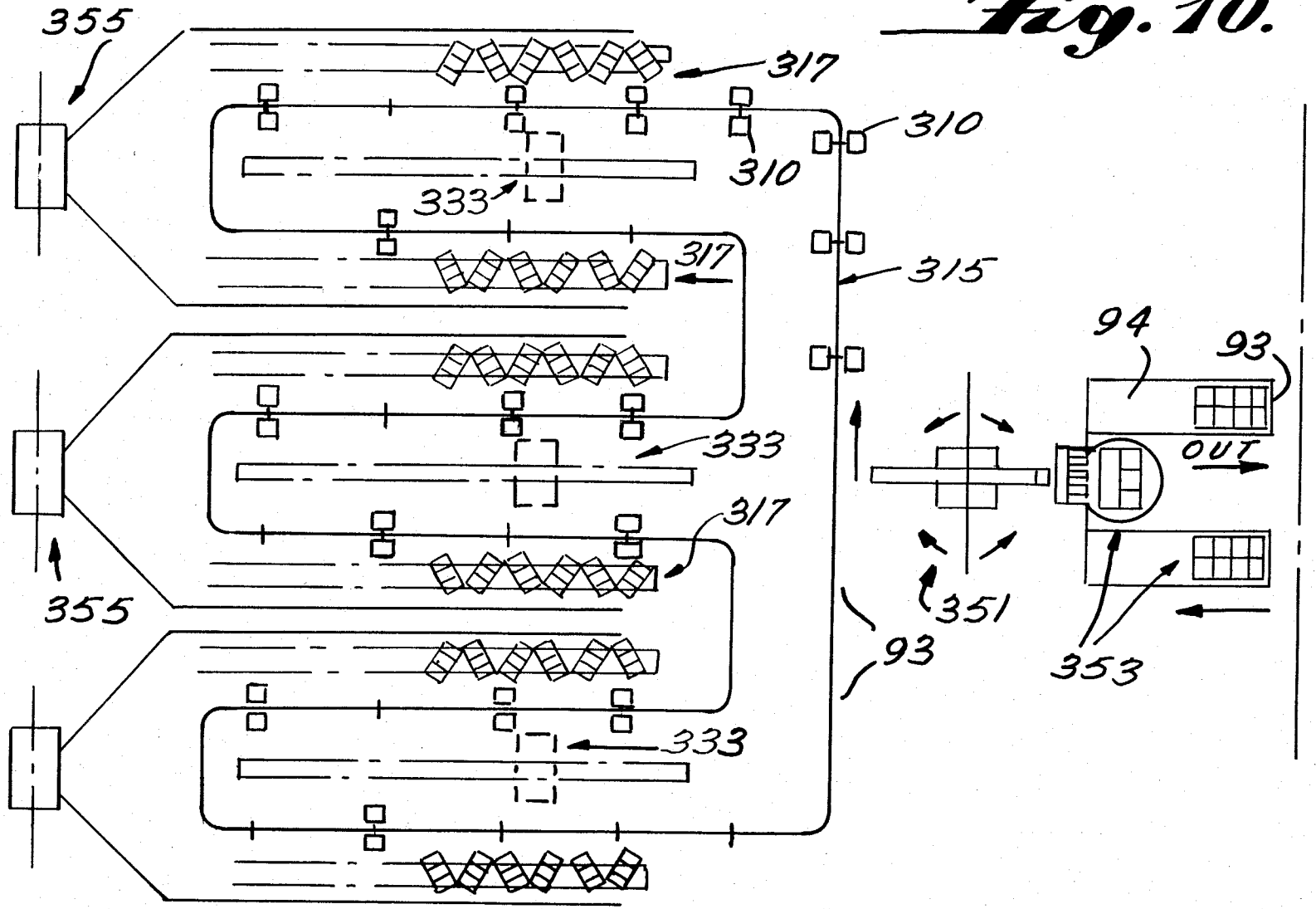
Figure 11:
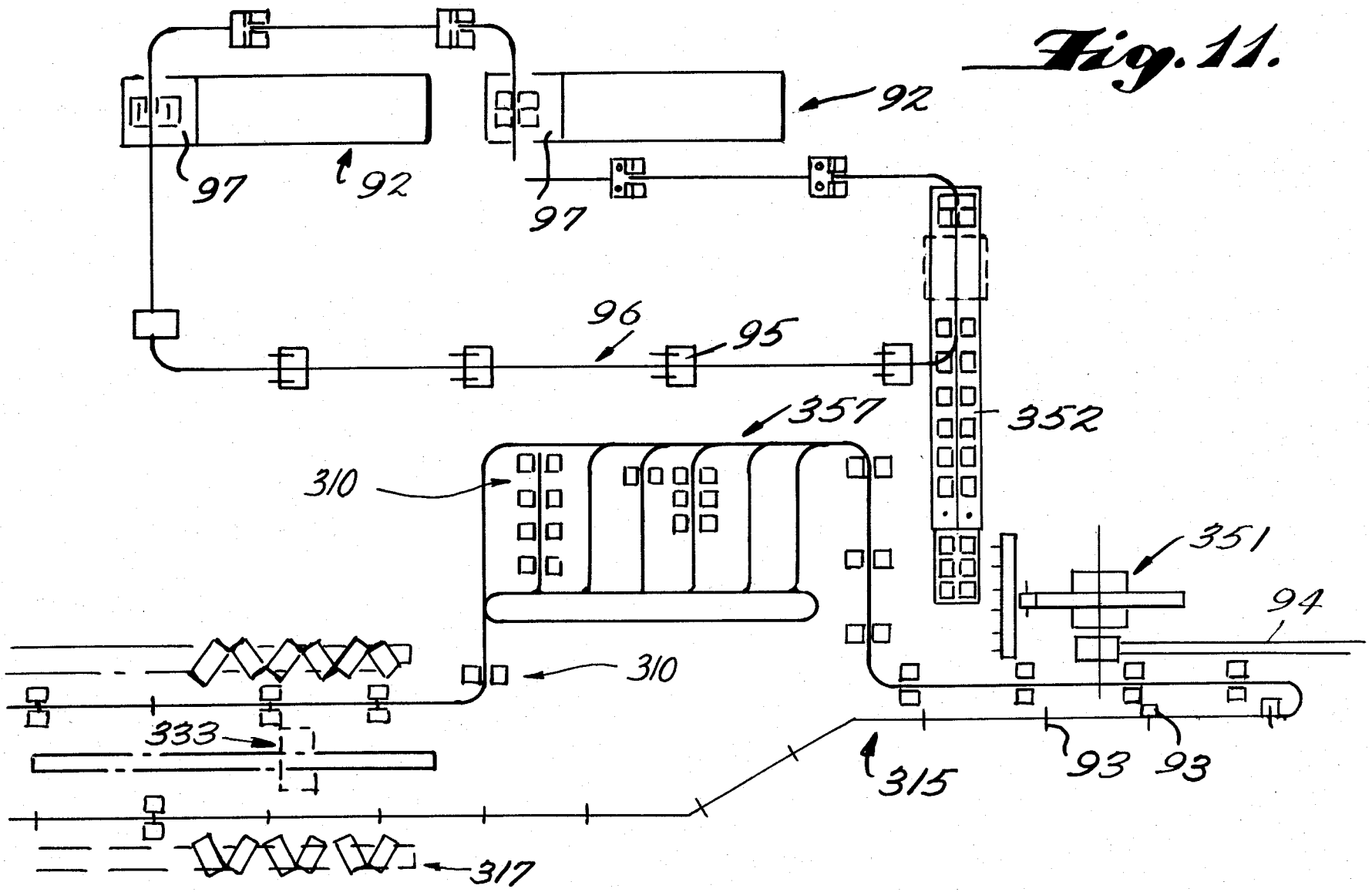

FIGS. *3a* through *3d* show an exemplary step-by-step operation for the continuous takeoff of yarn from a pair of modules at a single creeling position, FIG. *3a* showing the operative relationship between the modules and a creel frame, and FIGS. *3b* through *3d* not showing the creel frame, for clarity of illustration;

FIG. 4 is a perspective schematic view of a portion of an exemplary system according to the present invention;

FIG. 5 is a perspective schematic view of a more complete exemplary system according to the present invention;

FIG. 6 is a side view, partly in cross-section and partly in elevation, showing the interrelationship between an exemplary creel module, conveying component, and transporting component of the systems of FIGS. 4 and 5; and FIG. 7 is a schematic top view, partly in cross-section and party in elevation, of the exemplary creel module, conveying component, and transporting component of the mechanism of FIG. 6;

FIG. 8 is perspective schematic view of another exemplary creel module according to the present invention, shown in operative association with another exemplary form of overhead conveyor, and attachment thereto (i.e. distinct from the creel, etc. of the embodiment of FIG. 1);

FIG. 9 is a schematic perspective view of a portion of another embodiment of an exemplary creel frame according to the present invention, utilizable with the creel module of FIG. 8;

FIG. 10 is a perspective schematic view of another exemplary system according to the present invention; and FIG. 11 is a perspective schematic view of still another exemplary system according to the present invention.

DETAILED DESCRIPTION OF THE DRAWINGS

An exemplary creel module according to the present invention is shown generally by reference numeral 10 in the drawings. As illustrated most clearly in FIG. 1 and FIGS. *3a* through *3d*, each exemplary module 10 may comprise a central supporting rod 11, which is adapted to be vertically disposed, and a plurality of yarn package receiving creel pins 12 extending substantially horizontally from, and substantially perpendicular to, the rod 11. The creel pins 12 are adapted to receive yarn packages 13.

Each yarn package 13 comprises yarn, or another strand material, wrapped as a package. While the terms "yarn" and "yarn package" are used in the specification and claims for simplicity, it is to be understood that the term "yarn" is not limited to plied strands of textile fibers. Rather, the term encompasses any similar strands, including plied or monofilament, and including those of metal, glass, plastic, and the like.

Also associated with the rod 11 of creel module 10 is a mechanism 14 adapted to support the module 10 on an overhead conveyor 15 or the like. At the bottom of the rod 11 is a termination 16. The termination 16 is preferably adapted to facilitate positioning of the rod 11 in association with a stationary creel frame 17 (see FIG. 2) to present the packages 13 in appropriate position on the creel frame 17.

Preferably a plurality of rows of yarn-package receiving positions (i.e. creel pins 12) are provided associated with each creel module 10. For instance in the embodiment of the module 10 illustrated in FIG. 1, a first row A of creel pins 12 and a second row B of creel pins are provided. In the embodiment illustrated in FIG. 1, and FIGS. *3a* through *3d*, the creel pins 12 associated with the first row A are substantially in-line with the spindles associated with the second row B; as a matter of fact they can be the same continuous structure passing through horizontal openings spaced along the length of the rod 11.

Mounting means are provided associated with th creel module 10 and the creel frame 17 for mounting the module 10 in position so that yarn may be readily taken off the packages 13. In the embodiment illustrated in FIGS. 1, 2 and *3a*, such mounting means takes the form of a plate 18 affixed to the rod 11 and disposed vertically above the yarn packages 13, and a pair of spaced support surfaces 19 associated with creel frame 17 for receipt of the plate 18. The spaced support surfaces 19 preferably are generally horizontally extending, parallel, and at the same level. The plate 18 is dimensioned so as to span the distance between the surfaces 19, to be supported thereby (see FIG. *3a*). Upstanding flanges 21 between surfaces 19 are preferably provided to locate the sides of the plate 18, and a front cross member 22 (see FIG. 2) also is preferably provided to provide a stop for the plates 18. If desired, positioning projections 23 may be provided on the bottom of the plate 18 to engage corresponding dimples 25 formed in the surfaces 19 for precise positioning of the component.

Figure 2:
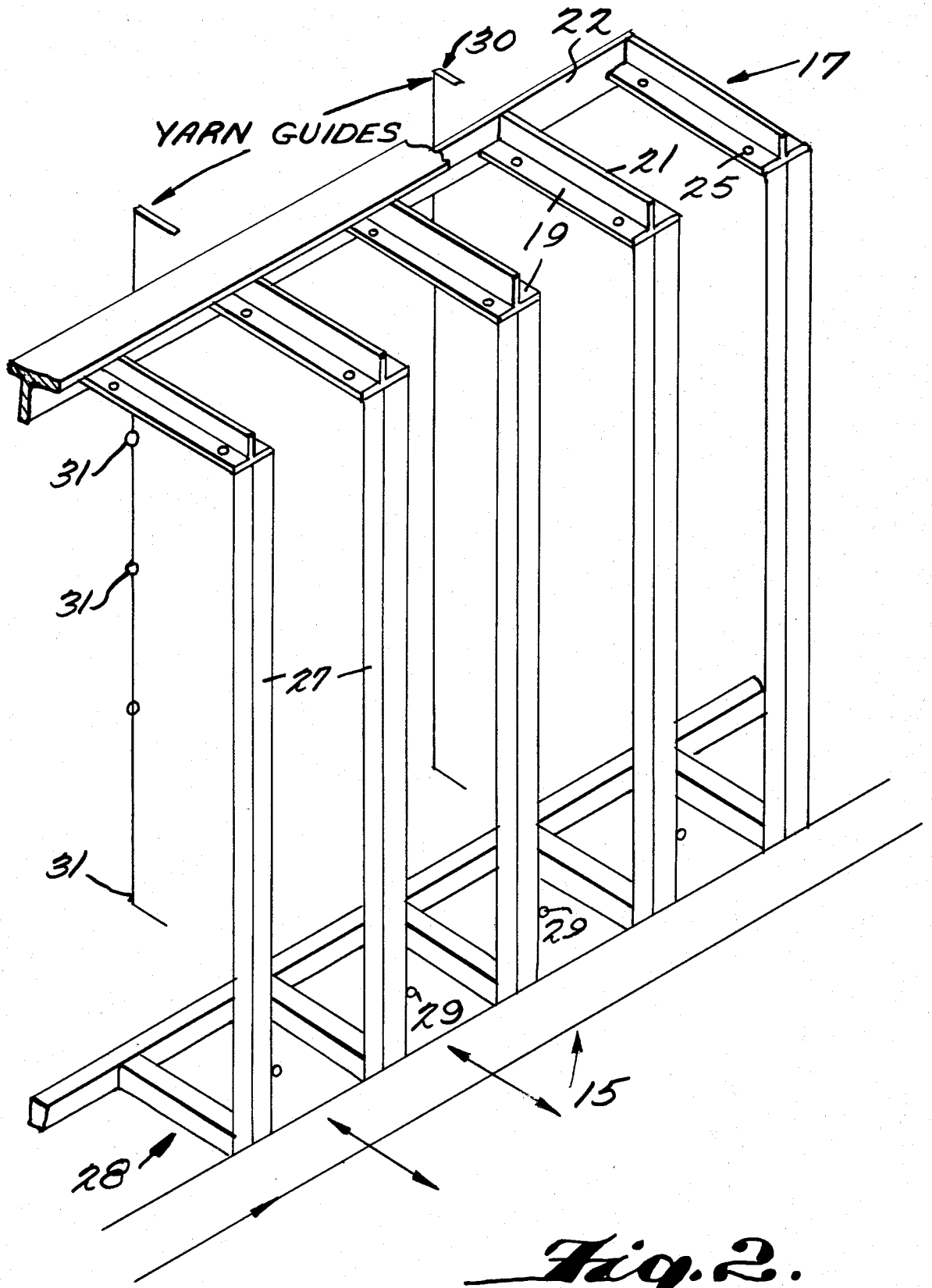
FIG. 2 is a schematic perspective view of a portion of an exemplary creel frame utilizable with the creel module of FIG. 1.
Figure 3A:
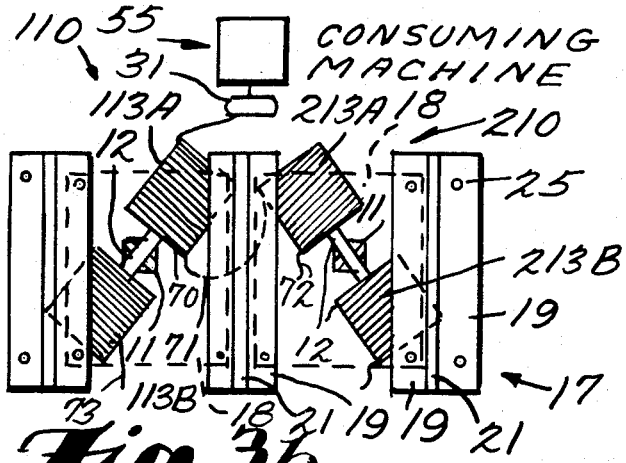

As illustrated in FIG. 2, spaced horizontally extending bars, rods, angle irons, or the like 27 support the surfaces 19 and flanges 21, the members 27 being connected at the bottoms thereof to a supporting frame 28. Depressions 29 receive rod terminations 16 for properly positioning the rods 11. The creel frame 17 is disposed adjacent the conveying means 15 so that the creel modules 10 may be readily transferred from the conveying means 15 into operative association with surfaces 19. Also, outwardly positioned from the cross support 22 and/or the base support 28 are yarn guide means 30. An individual yarn guide 31 is provided for each running yarn package 13 associated with each creeling position of the creel frame 17. In the embodiment illustrated in FIG. 2, which is adapted to be utilized with the specific modules 10 illustrated in FIG. 1, the yarn guide means 30 is associated with each pair of modules 10 (that is between two sets of surfaces 19).

Another embodiment of creel module and associated creel frame is illustrated in FIGS. 8 and 9. In this embodiment, structures corresponding to like structures in the FIGS. 1 and 2 embodiment are illustrated by the same reference numeral, only preceded by a "3".

The major difference between the module and creel frame of the FIGS. 8 and 9 embodiment, and the module and creel frame of the FIGS. 1 and 2 embodiment, is the deposition of the plate 18 with respect to the creel pins 12. In the FIGS. 1 and 2 embodiment, the sides of the plate 18 are non-parallel, and non-perpendicular with respect to the creel pins 12. In the FIGS. 8 and 9 embodiment, however, the sides of the plate 318 are either parallel or perpendicular to the creel pins 12. In order to properly position the yarn packages 313 for takeoff in the creel frame 317, the support surfaces 319 of the creel frame 317 are disposed at angular relationships with respect to each other, as clearly illustrated in FIG. 9. In this way, the same advantageous yarn doffing is possible utilizing the components of the FIGS. 8 and 9 embodiment as illustrated—with respect to the FIGS. 1 and 2 embodiment—and FIGS. 3*a* through 3*d*.

The FIG. 8 embodiment of the creel module also differs from the embodiment of FIG. 1 in the particular manner in which the rod 311 is interconnected to the overhead conveyor 315 (see, 339 and 342 in particular). However, either of the connections 39, 42 or 339, 342 may be utilized with the creel modules of the FIGS. 1 and 8 embodiments.

The method and system according to the present invention are not restricted to the type of conveying means 15, or transporting means (33) for transporting the modules 10 from the conveying means 15 to a creel frame 17. Any conventional conveying means or transporting means capable of performing the intended function may be utilized. One representative conveying means and one representative transporting means, and associated creel module support means 14, are illustrated most clearly in FIGS. 1 and 5–7.

The overhead conveyor includes a powered support 35 which is connected to some continuously movable conveying mechanism, such as a powered chain. The mechanism 35, and the powered mechanism, run in a track 36. An idler support 37 is operatively associated with each support 35, and a cross bar 38 extends therebetween. Connected to the cross bar 38 is a depending collar 39, which—as illustrated most clearly in FIGS. 6 and 7—may have a channel shape, closed on three sides, and open on the other. The collar 39 also has means defining detent-receiving recesses 40 therein, each for receipt of a detent 41 associated with the creel module support mechanism 14.

The support mechanism 14 includes an upstanding tube 42 which—as illustrated most clearly in FIG. 7—preferably is rectangular in cross-section, and mounts the detents 41 therein. The detents 41 are spring biased, as by coil springs 43 (see FIG. 7), to an outward position, passing through slots formed on opposite sides of the tube 42. When pressed outwardly to the positions illustrated in FIGS. 1, 6, and 7, the detents 41 enter the recesses 40 and hold the entire creel module 10 to the cross bar 38.

The detents 41 are preferably shaped as illustrated in FIGS. 6 and 7, including having a bottom projection 45 which is adapted to be engaged by the transporting means. Upon the exertion of a force in the direction of arrows F in FIG. 6 on the projections 45 by the transporting mechanism 33, the detents 41 are moved out of the openings 40 in the tube 42, and the rest of the creel module 10 may be detached from the conveying means 15.

The transporting means 33 may comprise a pair of arms 47 adapted to be moved toward and away from each other to engage, or move away from, the projections 45. Bottom support flanges 48 may be formed on the arms 47 for engaging the bottoms of the projections 45 to support the weight of the creel module 10 when grasped by the transporting mechanism 33.

The arms 47 are preferably mounted on an overhead crane structure, illustrated generally and schematically at reference numeral 49 in FIGS. 5 and 7. The overhead crane 49 includes a mechanism for rotating the arms 47 about a vertical axis between predefined positions (e.g. 180° apart detented positions), and also comprises means for moving the arms 47 toward and away from the collar 39, as indicated by arrow C in FIG. 7. Again, the invention is not restricted to the particular transporting means 33 utilized.

FIG. 8 shows a different type of support mechanism for the creel module 310 and is provided for the module 10 in FIG. 1 embodiment, and shows a different structure associated with the overhead conveyor 315 for cooperation with the support 314. In the FIG. 8 embodiment, a generally horizontally extending circular cross-section rod 339 is operatively connected to the cross bar 338, and cooperates with the generally horizontally extending circular cross-section tube 342 welded, or otherwise attached, to the top of flange 318. In this embodiment the transporting means 333 is basically the same as the transporting means 33 in the FIGS. 1–7 embodiment, except that the components for grasping the creel module 310 will be slightly different. Components of the transporting means 333 will grasp the tube 342, slide the tube 342 with respect to the rod 339 so they are no longer in engagement, and then transport the creel module 310 to the appropriate position on the creel frame 317. The overhead transporting means 333 also will preferably be capable of rotating the module 310 about a vertical axis in order to accomplish doffing, such as described with respect to FIGS. 3*a*–3*d*.

One embodiment of the system according to the present invention is illustrated most clearly in FIGS. 4 and 5. It includes automatic loading means for loading a plurality of yarn packages 13 on the receiving spindles 12 of the creel modules 10. Such automatic loading means are illustrated schematically by reference numeral 51 in FIGS. 4 and 5, and preferably comprise an industrial robot having any suitable means for pick-up of a plurality of packages in a storage container, such as carton 52 (FIG. 4), or a magazine 53 or a conveyor (see attached drawings) (FIG. 5), and movement of the yarn packages 13 onto the spindles 12 of a creel module 10.

Associated with the creel frame 17 of the system according to the invention is a consuming machine 55. The form the consuming machine 55 will take depends upon the particular processes being practiced utilizing the yarn packages 13. For instance in the textile industry, typical consuming machines 55 would be texturing machines, warping, twisting or cone winding machines, tufting machines, drawing machines, and ring spinning machines.

As illustrated in FIG. 5, a system may be provided utilizing a buffer storage area 57 in operative association with the closed loop overhead conveyor 15, the buffer storage area 57 for storing loaded creel module 10. Also, the system in FIG. 5 includes a first processing apparatus 58 for preparing the yarn packages 13. The yarn packages 13 once prepared are transported by conveyor 59, supported by transfer mechanism 60, to an automatic unloader 61 adjacent the magazine 59 or a conveyor. The yarn packages 13 are removed from the mechanism 60 by the unloader 61 and placed in the magazine 53, ultimately to be removed from magazine 53 by the robot loader 51.

In the practice of the method and in the utilization of the system according to the present invention, it is sometimes important to insure that all the yarn packages at all the creeling positions do not run out at the same time. This is so for large runs where simultaneous run-out would make it impossible to maintain continuous operation. The method and system according to the invention are designed so that only a few of the creel modules 10 at a few of the creeling positions associated with creel frame 17 need replacement at any one time. This desirable design objective is preferably facilitated by utilizing metered yarn packages 13—i.e. yarn packages having a precisely controlled length of yarn thereon. This allows all the yarn packages associated with a given row of spindles to run out at the same time, and by varying the metered size of the yarn packages at start-up the desired sequence of yarn package exhausting is initiated.

A typical manner of utilizing metered yarn packages at start-up in the practice of the method according to the present invention for large runs is most readily apparent from an inspection of Table I, below. As illustrated by this table, the sizes of the metered yarn packages 13 at start-up are graduated by modular row across all creel positions so that they are different, and will run out at different times. For instance, for module 1, packages 1–5 for creel positions 1–6, the metered sizes of the yarn packages are graduated in 100 yard increments from 100 to 600 yards, respectively, while for module 4, packages 5–10 for creel positions 1–6, the metered sizes of the yarn packages are 500 yards through 0 yards, respectively. Once start-up has been initiated, all replacement creel modules will have full yarn packages of equal metered size (e.g. 600 yards for the exemplary system illustrated in Table I).

TABLE I

Creel capacity of consuming machine: 56 modules
Number of ends to be delivered to consuming machine: 30
Capacity per module: 5 packages/row
2 rows/modules
10 (5 × 2) packages/module
Capacity per package: 600 yards (full)
Production requirements: 4200 yards

| Creel Position | Package No. | Module Row No. | Yards/Package/Row By Module Number #1 | #2 | #3 | #4 | Total Yards |
|---|---|---|---|---|---|---|---|
| 1 | 1-5 | 1 | 100 | 600 | 600 | 600 | |
| | 5-10 | 2 | 600 | 600 | 600 | 500 | 4200 |
| 2 | 1-5 | 1 | 200 | 600 | 600 | 600 | |
| | 5-10 | 2 | 600 | 600 | 600 | 400 | 4200 |
| 3 | 1-5 | 1 | 300 | 600 | 600 | 600 | |
| | 5-10 | 2 | 600 | 600 | 600 | 300 | 4200 |
| 4 | 1-5 | 1 | 400 | 600 | 600 | 600 | |
| | 5-10 | 2 | 600 | 600 | 600 | 200 | 4200 |
| 5 | 1-5 | 1 | 500 | 600 | 600 | 600 | |
| | 5-10 | 2 | 600 | 600 | 600 | 100 | 4200 |
| 6 | 1-5 | 1 | 600 | 600 | 600 | 600 | |
| | 5-10 | 2 | 600 | 600 | 600 | 0 | 4200 |

For the embodiments in FIGS. 10 and 11, the creel modules 310 and the stationary creel frames 317 are utilized. All structures illustrated in the FIGS. 10 and 11 embodiment, corresponding generally in function to structures illustrated in the FIGS. 4 and 5 embodiment, are indicated by the same reference numeral, only preceded by a "3".

In the FIG. 10 embodiment, the consuming machines 355 are warpers, while in FIG. 11 a warping system is shown in association with Autocord open end machines 92. In the FIG. 10 embodiment, the robot 351 loads from a conveyor and turntable assembly 353. Tubes from empty yarn packages (the tubes being illustrated by reference numerals 93 in FIG. 10) are also removed by robot 351, transferred to the turntable and passed out outlet conveyor 94. The robot 351 can rotate both about a horizontal and a vertical axis.

In the FIG. 11 embodiment, empty creel modules 95 associated with conveying mechanism 97 are filled from the open-end machines 92 (by package devices 97 associated therewith) and passed to package accumulation conveyor 352, which then provides packages for robot 351. Empty tubes 93 are also withdrawn by the robot 351, and passed out empty tube conveyor 94.

OPERATION

With particular reference to FIGS. 4 and 5, an exemplary method of textile creeling and doffing will now be described. The method comprises the following steps:

(a) Loading each creel module 10 one or more yarn package positions (creel pins) 12 with yarn packages 13. (b) Conveying the loaded modules 10 to a creeling position, utilizing conveyor 15 and transferring means 33. (c) In a textile process (e.g. texturing), progressively taking yarn off the yarn packages 13 of the creel module 10 while at the creeling position of frame 17. (d) After exhausting of the yarn packages 13 of the creel module 10, removing the exhausted module 10 from the creeling position on frame 17 and replacing it with another loaded module 10; and (e) continuously repeating steps (a) through (d) utilizing the module 10.

Figure 3C:
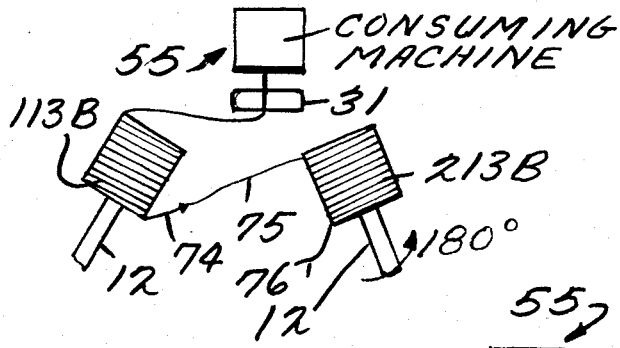
Figure 3D:
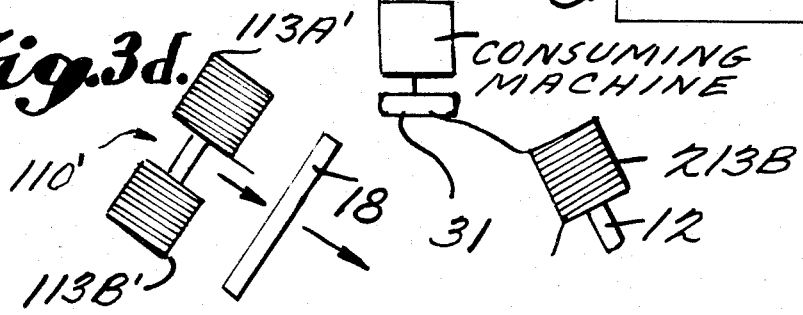

Preferably at each creeling position on creel frame 17 there are two creel modules 10 with multiple creel pins. The details of the practice of the method according to the invention utilizing a pair of creel modules at each creeling position will now be described with respect to FIGS. 3*a* through 3*d*, the first creel module being illustrated by reference numeral 110 and having yarn packages 113A in the first row thereof, and yarn packages 113B in the second row thereof, and the second creel module at the creeling position being illustrated by reference numeral 210 and having yarn packages 213A in the first row thereof, and yarn packages 213B in the second row thereof. A replacement loaded first creel module 110' is illustrated in FIG. 3*d*.

With reference to FIGS. 3*a* through 3*d*, a method of continuously taking off yarn from yarn packages comprises the steps of:

(a) At start-up, providing at least a first creel module 110 at the creeling position on stationary creel frame 17, both rows of the first creel module being loaded with yarn packages (e.g. 113A, 113B). (b) Taking off yarn from the yarn packages in the first row of the first creel module 10. (c) Providing a second creel module 210 at the creeling position on frame 17, the module 210 being loaded with yarn packages 213A, 213B. The module 210 may initially be at the frame 17 at step (a), or transferred to it during the practice of step (b). (d) Attaching a transfer tail 70 of each yarn package 113A of the first creel module first row to a running end 71 of a yarn package 213A of the second creel module first row. (e) After exhausting the yarn from the yarn packages 113A in the first creel module first row, taking off the yarn from the yarn packages 213A of the second creel module first row, while attaching a transfer tail 72 from each yarn package 213A of the second creel module first row to a running end 73 of a yarn package 113B of the first creel module second row. (f) After exhausting the yarn from the yarn packages 213A of the second creel module first row, taking off the yarn from the yarn packages 113B of the first creel module second row, while attaching a transfer tail 74 of each yarn package 113B of the first creel module second row to a running end 75 of a yarn package 213B of the second creel module second row. (g) After exhausting the yarn from the yarn packages 113B of the first creel module second row, taking off the yarn from the yarn packages 213B of the second creel module second row. (h) While practicing step (g), replacing the first creel module 110 with another, first, loaded creel module, and attaching the running end of each yarn package of the replaced first creel module first row to a tail 76 of a yarn package 213B of the second creel module second row. (i) After exhausting of the yarn from the yarn packages 213B of the second creel module second row, replacing the second creel module 210 with another, loaded, second creel module; and then (j) continuously repeating steps (b) through (i).

After the yarn on package 113A is exhausted and the running end has transferred to 213A, the first module must be rotated such that package 113B is positioned for running. At that point, the transfer tail of package 213A may be joined with running end 113B. Similarly, the second module must be rotated after exhausting its first package, 213A, is completed. A similar transfer tail joining process may then be performed, etc. Rotational process is accomplished via the transporting mechanism, etc.

It will thus be seen that according to the present invention a method and system are provided for minimizing the labor input in the doffing and creeling of yarn packages, while reducing waste and improving machine efficiency. Since all of the steps—except for the tying of the yarn package ends to each other—can be accomplished automatically, a central computer control 90 (see FIG. 5) may be provided operatively interconnected to the loading means 51, magazine loader 61, conveyor means 15, transporting means 33, and the consuming machine 55.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and systems.

What is claimed is:

1. A textile creeling and doffing method, utilizing a stationary creel frame including a plurality of movable modules disposed at various positions within the creel frame, each module having a plurality of yarn package positions thereon, comprising the steps of sequentially:

(a) loading the yarn package positions of a module with yarn packages;

(b) conveying the loaded module to a position within the stationary creel frame;

(c) in a textile process, progressively taking yarn off the yarn packages of a module while in said position within the creel frame;

(d) after exhausting the yarn packages of a module, removing the exhausted module from said position within the creel frame and replacing it with another loaded module while step (c) is being simultaneously performed for other modules at other positions within the creel frame; through and (e) continuously repeating steps (a) through (d) for the plurality of modules and creel frame positions.

2. A method as recited in claim 1 wherein the textile process in step (c) is yarn texturing.

3. A method as recited in claim 1 wherein the textile process in step (c) is selected from the group consisting of spinning, tufting, twisting, warping, roving, drawing, and cone winding.

4. A method as recited in claim 1 comprising the further step of providing both loaded and exhausted modules in buffering areas, for loaded modules said buffering being practiced between steps (a) and (b).

5. A method as recited in claim 1 wherein all of the yarn packages loaded in step (a) are metered packages.

6. A method as recited in claim 5 wherein a plurality of creeling positions are provided and a plurality of creel modules are conveyed to the creeling positions; and wherein prior to start-up of the textile process of step (c), steps (a) and (b) are practiced so that the metered yarn packages initially at the creeling positions are of different size so that all packages are not exhausted at the same time.

7. A method as recited in claim 6 wherein after start-up the other loaded modules utilized in step (d), all have yarn packages of the same metered size.

8. A method as recited in claim 1 wherein each creel module comprises a plurality of distinct rows of yarn package positions; and wherein steps (b) and (c) are practiced so that a plurality of modules are provided at each creel position; and comprising the further step of, after exhausting of the yarn packages in a first row of a first of said plurality of modules at a creeling position, taking off yarn from the yarn packages of a first row of a second of said plurality of modules at said creeling position, and ultimately moving said first creel module at said creeling position so that the yarn packages in a second row thereof are in position to be taken off.

9. A method as recited in claim 8 wherein two rows of yarn package positions are provided associated with each creel module, and wherein two creel modules are provided at each creeling position, and wherein step (c) is practiced so that the yarn from the yarn packages in the first row of the first creel module at the creeling position is exhausted, then the yarn from the yarn packages in the first row of the second module at the creeling position, then the yarn from the yarn packages of the second row of the first module, and then the yarn from the yarn packages of the second row of the second module; and wherein step (d) is practiced so that the first module is replaced with another loaded module while yarn is being taken off from the yarn packages of the second row of the second module.

10. A method as recited in claim 9 wherein all of the yarn packages loaded in step (a) are metered packages.

11. A creeling system comprising:

a plurality of creel modules, each module having one or a plurality of yarn package-receiving creel pins associated therewith, formed in at least one row;

means for loading yarn packages onto said creel pins at a loading station;

means for conveying said modules to and from said loading station;

a stationary creel frame for receipt of a plurality of said modules;

means for transferring said modules from said conveying means to said stationary creel frame, and from said creel frame to said conveying means; and cooperating mounting means on each of said modules and said creel frame for holding said modules in position on said creel frame for removal of yarn from the yarn packages received by said modules.

12. A system as recited in claim 11 wherein said loading means, conveying means, and transferring means are automatic, powered structures; and further comprising a central control means for automatically controlling said structures.

13. A system as recited in claim 11 wherein each of said modules comprises two rows of creel pins, with a plurality of creel pins in each row, and wherein each creel pin in each row is disposed substantially in line with a creel pin in another row.

14. A system as recited in claim 13 wherein said mounting means comprises a pair of spaced mounting surfaces of said creel frame, and a mounting plate of each module, said mounting plate being disposed vertically above all of said creel pins of said module, and dimensioned to span the space between the creel frame mounting surfaces, and to operatively engage said creel frame mounting surfaces.

15. A system as recited in claim 13 wherein said transferring means comprises means for holding said module; means for linearly moving said module generally perpendicular to the direction of conveyance thereof by said conveying means; and means for rotating said module 180° about a vertical axis.

16. A system as recited in claim 11 wherein said conveying means includes buffer storage means for storing a plurality of modules in a conveyance position between said loading station and said creel frame.

17. A system as recited in claim 11 wherein said transferring means comprises: means for holding said module; means for linearly moving said module generally perpendicular to the direction of conveyance thereof by said conveying means; and means for rotating said module.

18. A method of continuously taking off yarn from yarn packages at a predetermined stationary creeling position, utilizing first and second creel modules at a single take-off position, each of the modules comprising first and second distinct rows of yarn package-receiving positions, comprising the steps of sequentially:

(a) a start-up, providing at least a first creel module at the creeling position, both rows of the first module being loaded with yarn packages;

(b) taking off yarn from the yarn packages in the first row of the first module;

(c) providing a second module at the creeling position, the second module being loaded with yarn packages;

(d) attaching a transfer tail of each yarn package of the first module first row to a running end of a yarn package of the second module first row;

(e) after exhausting the yarn from the yarn packages in the first module first row, taking off the yarn from the yarn packages of the second module first row, while attaching a transfer tail from each yarn package of the second module first row to a running end of a yarn package of the first module second row;

(f) after exhausting the yarn from the yarn packages of the second module first row, taking off the yarn from the yarn packages of the first module second row, while attaching a transfer tail of each yarn package of the first module second row to a running end of a yarn package of the second module second row;

(g) after exhausting the yarn from the yarn packages of the first module second row, taking off the yarn from the yarn packages of the second module second row;

(h) while practicing step (e), replacing the first module with another, first, loaded module, and attaching the running end of each yarn package of the replaced first module first row to a transfer tail of a yarn package of the second module second row;

(i) after exhausting the yarn from the yarn packages of the second module second row, replacing the second module with another, loaded, second module; and then (j) continuously repeating steps (b) through (i).

19. A method as recited in claim 18 wherein all of the yarn packages are metered yarn packages, all the yarn packages in each module row being the same metered size; and wherein at start-up, in steps (a) and (c), the yarn packages in one row of one module at one creeling position have a predetermined metered size different from the yarn packages in all the other module rows at said creeling positions; and wherein steps (h) and (i) are practiced by replacing the first and second modules with modules having yarn packages in the first row thereof of the same metered size as in the second row thereof, and each of the yarn packages in the first and second replacement modules being of the same metered size.

20. A method as recited in claim 18 wherein during start-up, in step (a) and (c), the first module first row and the second module second row are in desirable yarn take-off positions; and wherein during the practice of step (e) the first module is moved so that the second row thereof is in said desirable yarn take-off position; and wherein during the practice of step (f) said second module is moved so that the second row thereof is in said desirable yarn take-off position.

21. A method as recited in claim 20 wherein said first and second yarn module moving steps are accomplished by rotating said first and second modules approximately 180 ° about a vertical axis.

* * * * *